United States Patent [19]

Raab et al.

[11] 4,022,994

[45] May 10, 1977

[54] SLIDE ACTION ELECTRICAL SWITCHES HAVING CONTACT DETENTING STRUCTURE

[75] Inventors: Andrew F. Raab, Morton Grove; Raymond T. Halstead, Wheeling, both of Ill.

[73] Assignee: Indak Manufacturing Corporation, Northbrook, Ill.

[22] Filed: May 28, 1975

[21] Appl. No.: 581,545

[52] U.S. Cl. ..... 200/16 C; 200/291

[51] Int. Cl.[2] ..... H01H 15/02; H01H 1/50

[58] Field of Search ..... 200/16 B, 16 C, 16 D, 200/16 F, 11 EA, 11 K, 291, 61.86

[56] References Cited

UNITED STATES PATENTS

| | | | |
|---|---|---|---|
| 2,880,284 | 3/1959 | Laete | 200/16 C |
| 2,994,748 | 8/1961 | Long | 200/16 C X |
| 3,085,486 | 4/1963 | Bushman et al. | 200/16 D |
| 3,223,794 | 12/1965 | Hoy et al. | 200/16 C |
| 3,254,163 | 5/1966 | Wanlass | 200/16 C X |
| 3,255,319 | 6/1966 | Paine | 200/291 X |
| 3,339,032 | 8/1967 | Hults | 200/16 C |
| 3,549,832 | 12/1970 | Ferryman, Jr. | 200/16 C |
| 3,643,046 | 2/1972 | Zdanys, Jr. et al. | 200/16 D X |
| 3,721,779 | 3/1973 | Raab | 200/61.86 X |
| 3,934,101 | 1/1976 | Jones | 200/16 D |

*Primary Examiner*—James R. Scott
*Attorney, Agent, or Firm*—Burmeister, York, Palmatier, Hamby & Jones

[57] ABSTRACT

Electrical switches are disclosed which are of the type having a slidable contactor which is movable along a predetermined path in a casing. The contactor is engageable with a plurality of electrical contacts disposed along said path. To provide for selective engagement between the contactor and the contacts, at least one fixed cam element is provided along the path of the contactor and is engageable by one or more follower elements on the contactor to lift the contactor away from at least one of said contacts in at least one position of said contactor. In certain embodiments, the contactor is preferably formed with a slot which is adapted to receive an insulating projection on the carriage, so that the contactor is caused to move in a precise manner along with the carriage.

7 Claims, 29 Drawing Figures

SLIDE ACTION ELECTRICAL SWITCHES HAVING CONTACT DETENTING STRUCTURE

This invention relates to electrical switches, particularly automotive switches which are used on automobiles and other vehicles to carry out various switching functions. However, the switches of the present invention are applicable to many types of service, in addition to automotive service.

One object of the present invention is to provide a new and improved electrical switch which is basically simple and highly economical, yet is capable of carrying out complex switching functions. Another object is to provide a new and improved electrical switch in which the contactor is mounted on its supporting carriage in a new and improved manner, to provide for highly precise movement of the contactor when the carriage is moved along its path in the switch.

To carry out these objects, the present invention provides an electrical switch having a carriage which is movable in a casing, and a contactor which is mounted on the carriage and is movable therewith. The contactor is selectively engageable with a plurality of fixed contact elements or points which are disposed along the path of movement of the contactor. To provide for complex switching functions, at least one cam element is provided along the path of movement of the contactor and is engageable by a cam follower element on the contactor, so as to lift the contactor away from at least one position of the contactor.

The contactor may be formed with one or more cutouts or recesses adapted to receive the cam element so that the contactor will not be lifted away from any of the contacts by such cam element. A wide variety of switching functions can be carried out by changing the number and location of the cam elements.

The switches of the present invention preferably utilize a contactor in the form of a conductive member having a slot therein for receiving an insulating projection on the carriage. By virtue of this construction, the contactor is moved by the carriage with a high degree of precision and consistency.

Further objects, advantages and features of the present invention will appear from the following description, taken with the accompanying drawings, in which.

Figure 8:
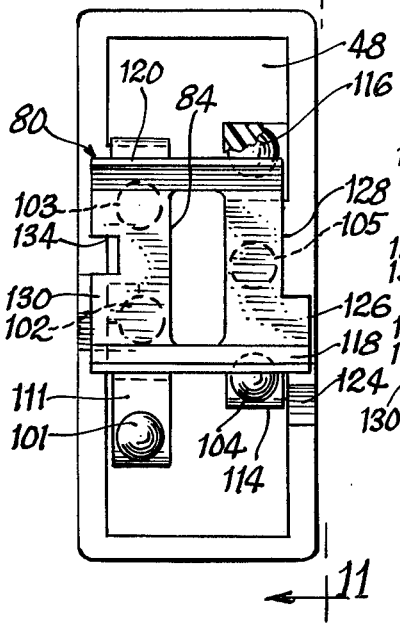
FIGS. 8, 9 and 10 are enlarged views showing three successive positions of the contactor in the switch of FIGS. 1–7, in relation to the fixed contacts and their supporting member, the remainder of the switch being removed for clarity of illustration.
Figure 9:
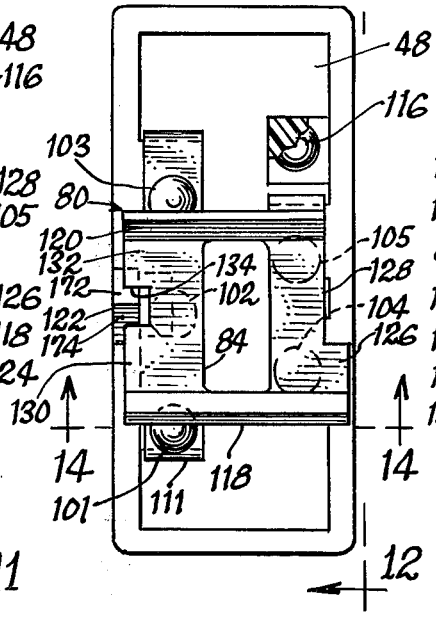
Figure 10:
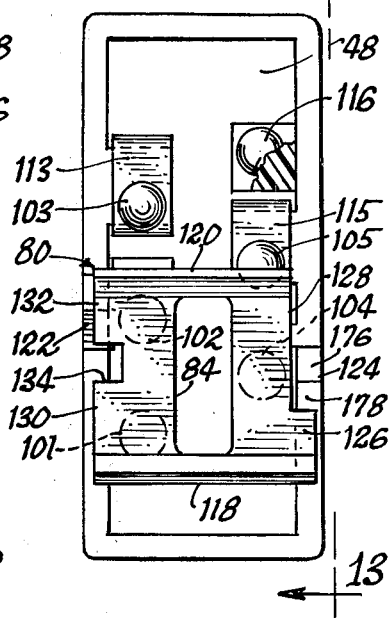
Figure 11:
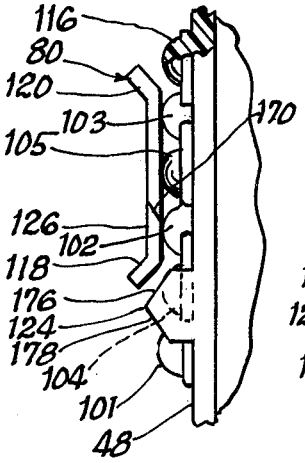
Figure 12:
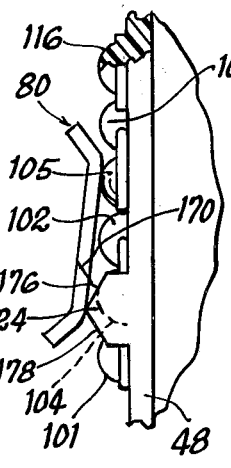
Figure 13:
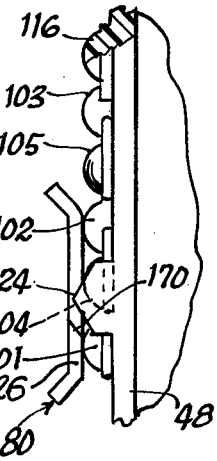

FIGS. 11, 12 and 13 are fragmentary elevational views, taken generally as indicated by the lines 11—11, 12—12 and 13—13 in FIGS. 8, 9 and 10, respectively.

Figure 14:
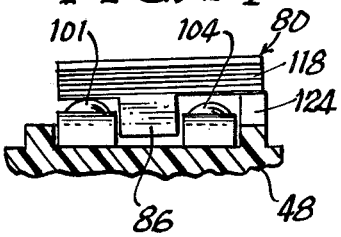

FIG. 14 is a fragmentary section taken generally along the line 14—14 in FIG. 9.

Figure 15:
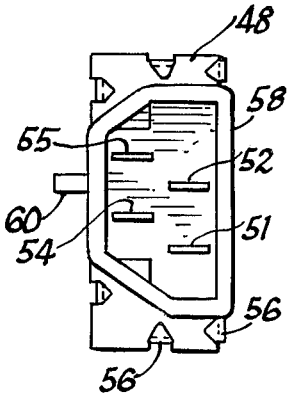
Figure 16:
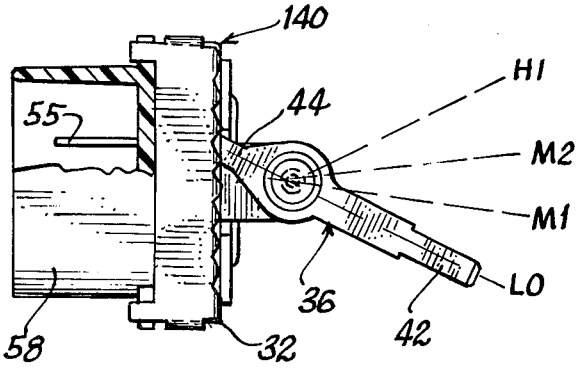

FIGS. 15 and 16 are rear and side views of a modified switch to be described as a second illustrative embodiment of the present invention.

Figure 17:
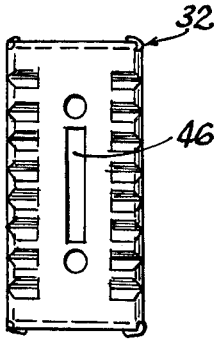

FIG. 17 is a front view of the casing for the switch of FIGS. 15 and 16.

Figure 18:
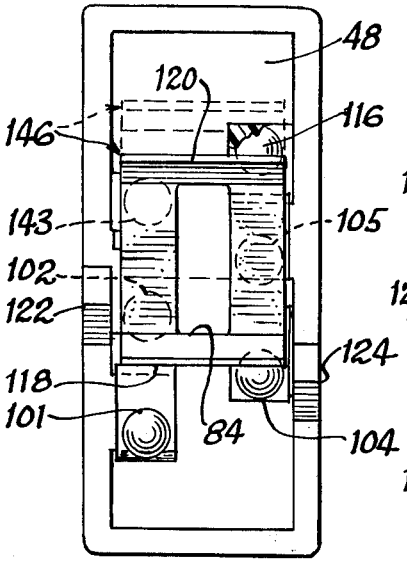
Figure 19:
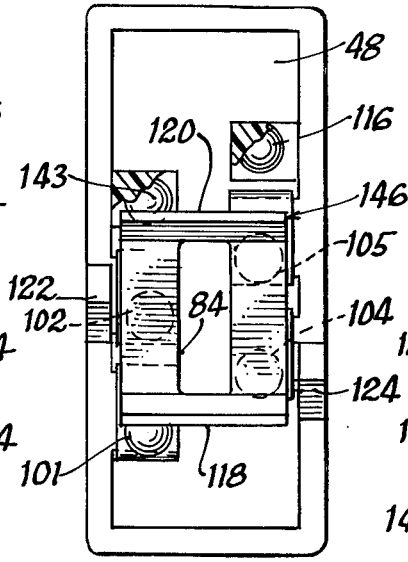
Figure 20:
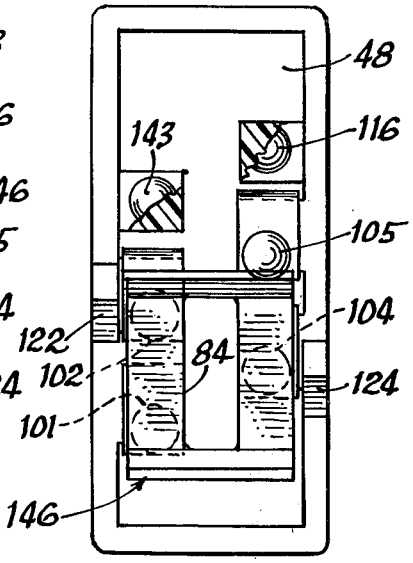

FIGS. 18, 19 and 20 are enlarged views showing three successive positions of the contactor for the switch of FIGS. 15–17, in relation to the fixed contacts and their supporting member.

Figure 21:
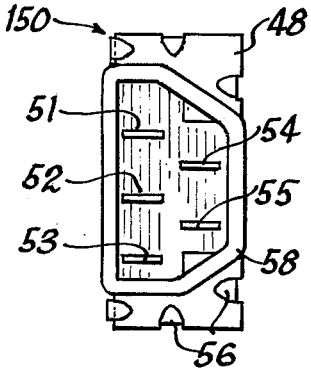
Figure 22:
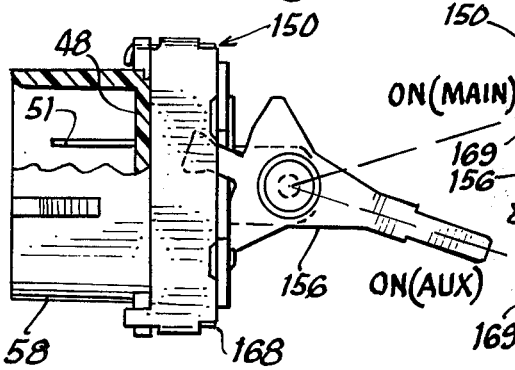
Figure 23:
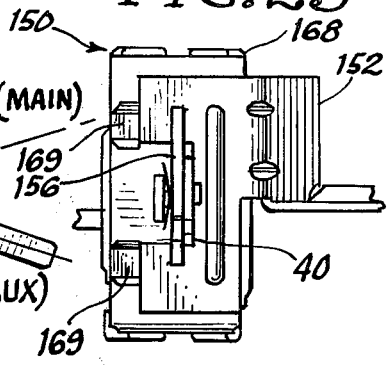

FIGS. 21, 22 and 23 are rear, side and front views showing another modified switch to be described as a further illustrative embodiment of the present invention.

Figure 24:
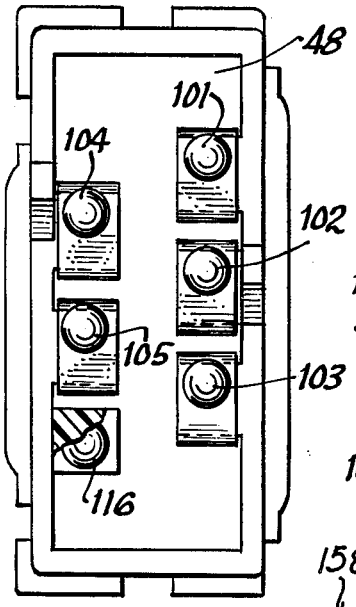

FIG. 24 is an enlarged view showing the fixed contacts and their supporting member for the switch of FIGS. 21–23.

Figure 25:
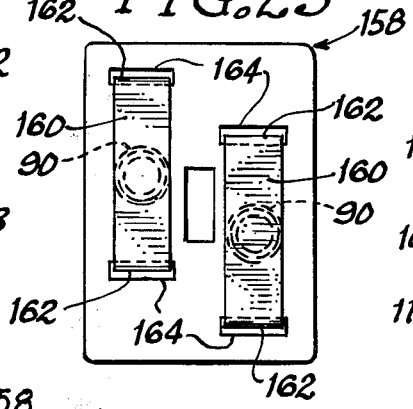

FIG. 25 is a rear view of the contactor and carriage assembly for the switch of FIGS. 21–24.

Figure 26:
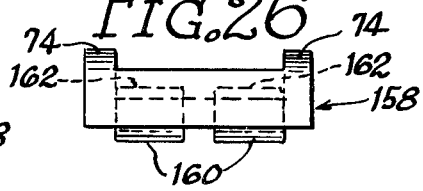

FIG. 26 is a top view of the contactor and the carriage assembly shown in FIG. 25.

Figure 27:
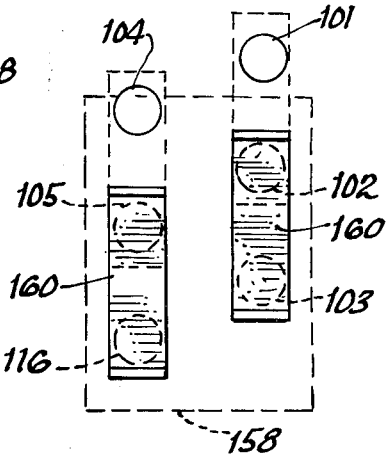

FIG. 27 is a diagrammatic view showing two successive positions of the contactors for the switch of FIGS. 21–26, in relation to the fixed contacts shown in FIG. 24.

Figure 28:
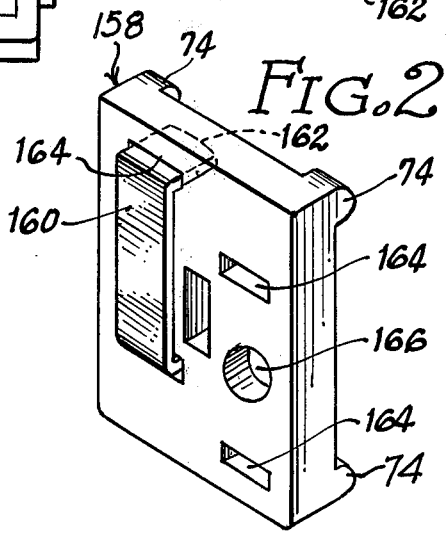

FIG. 28 is a perspective view of the contactor and carriage assembly of FIGS. 25 and 26, the assembly being shown partially disassembled.

Figure 29:
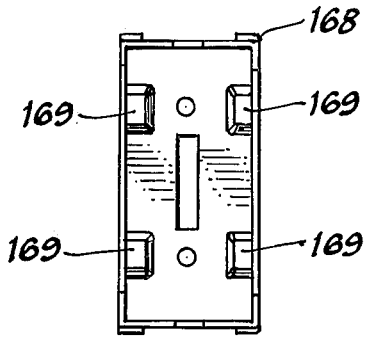

FIG. 29 is a rear view of the casing for the switch of FIGS. 21–28.

As just indicated, FIGS. 1–14 illustrated an electrical switch 30 which is intended particularly for use on automobiles or other vehicles, but will find many other applications. More specifically, the switch 30 is intended for use in connection with the air-conditioning system of a vehicle.

The illustrated switch 30 comprises a casing 32 which happens to be rectangular in shape but may be of some other shape. As shown, the casing 32 is made of metal but may be made of other suitable materials. In this case, a mounting bracket 34 is secured to the casing 32.

The switch 30 has a movable operating member which happens to be in the form of a control lever 36, but may assume various other forms. The illustrated lever 36 is swingable about a pivot in the form of a rivet 38 secured to a forwardly projecting arm 40 on the mounting bracket 34. As shown, the lever 36 has a forwardly projecting operating arm 42 and a rearwardly projecting arm 44 which extends into the casing 32 through a slot 46.

Means are provided to establish electrical connections to the switch 30. As shown, the switch 30 has an insulating member or plate 48 for supporting a plurality of terminals 51–55 in the form of rearwardly projecting prongs or blades, adapted to receive a connector. The terminal supporting member 48 is suitably secured to the casing 32, as by means of the illustrated tabs 56 which project rearwardly from the casing 32 and are bent behind the member 48.

To mate with a connector, the illustrated terminal supporting member 48 is provided with an insulating shroud 58 which projects rearwardly and forms a perimeter wall around the terminals 51–55. The shroud 58 is of an irregular shape and is adapted to serve as a guide to insure that the connector will be correctly oriented in relation to terminals 51–55. For use in retaining the connector, the shroud 58 is formed with a latching projection 60, adapted to be engaged by a latching member on the connector. It is preferred to form the terminal support 48 and the shroud 58 in one piece from a suitable resinous plastic material affording good electrical insulation and high resistance to heat and breakage.

In the illustrated switch 30, the operating lever 36 has three operating positions which are designated HI, AUTO-HI and AUTO-LO. The terms HI and LO may refer to the speed of the circulating fan in the air-conditioning system. The term AUTO may refer to the automtic temperature control, employed in the air-conditioning system. The number of operating positions and the functions which are controlled in such positions may be varied.

Figure 1:
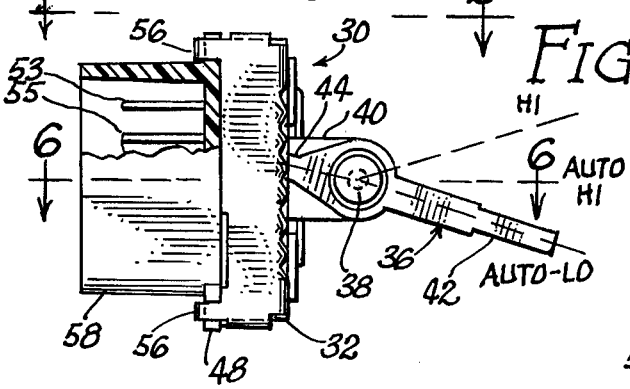
FIGS. 1, 2 and 3 are side, plan and rear views of an electrical switch to be described as an illustrative embodiment of the present invention.
Figure 2:
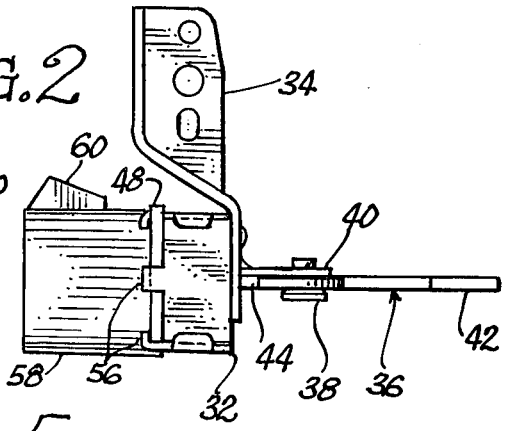
Figure 3:
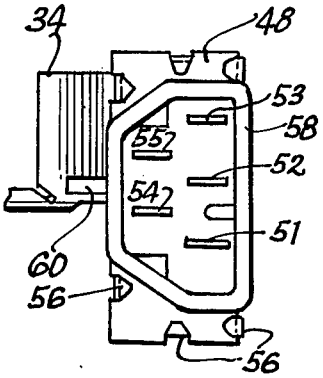
Figure 5:
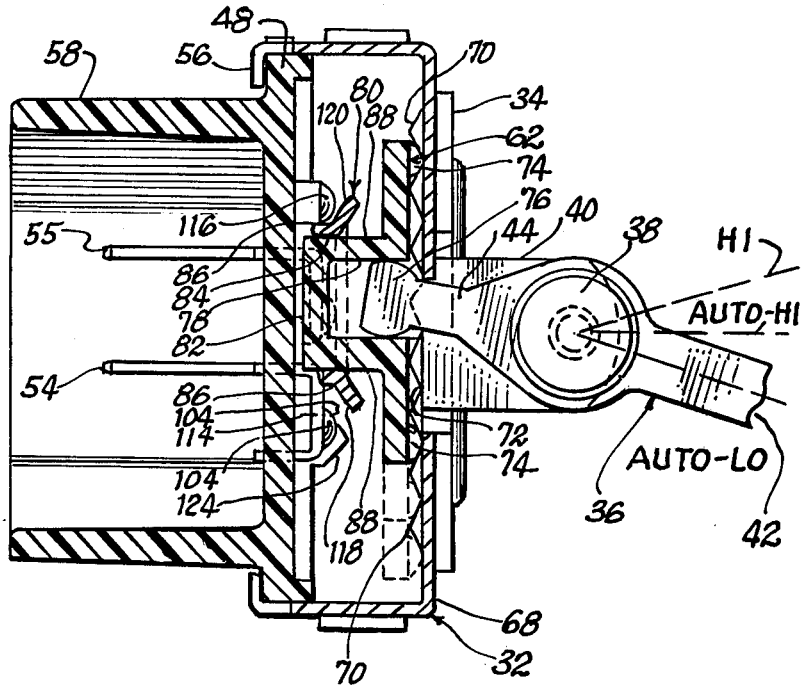
FIG. 5 is an enlarged vertical section, taken generally as indicated by the line 5—5 in FIG. 4.
Figure 4:
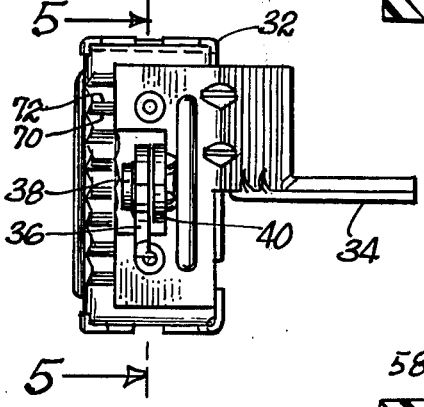
FIG. 4 is a front elevation of a switch of FIGS. 1–3.
Figure 6:
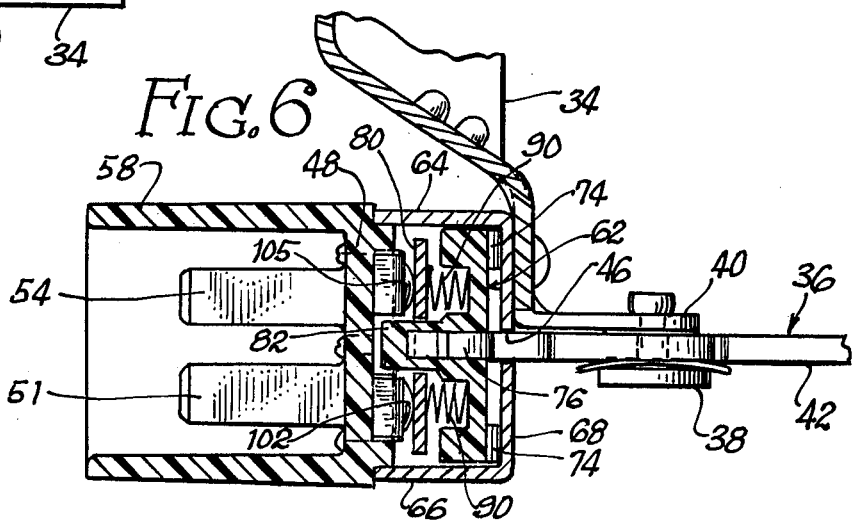
FIG. 6 is an enlarged section taken generally along the line 6—6 in FIG. 1.
Figure 7:
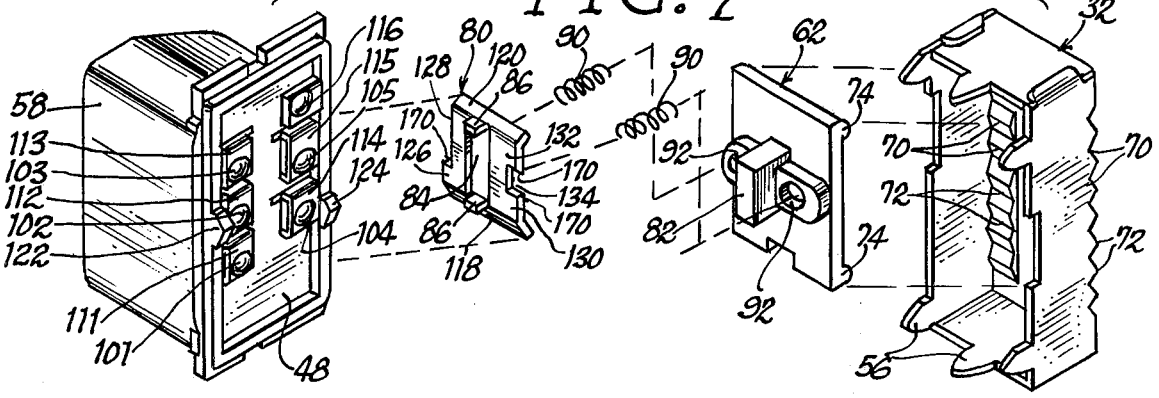
FIG. 7 is an exploded perspective view showing the disassembled components of the electrical switch of FIGS. 1–6.

As shown in FIGS. 5–7, the illustrated switch 30 has an insulating carriage 62 which is movable along a predetermined path within the casing 32. In this case, the path of the carriage 62 is straight and linear, but the path might be of some other shape. The illustrated casing 32 has a pair of parallel side walls 64 and 66 which guide the movement of the carriage 62. The casing 32 also has a front wall 68 along which the carriage 62 is slidable. The front wall 68 is preferably formed with a series of detent projections 70 alternating with detent recesses 72, adapted to be engaged by detent projections 74 on the carriage 62. The illustrated carriage 62 is formed with four such detent projections 74, adapted to ride over the detent projections 70 and into the detent recesses 72 on the casing 32. By means of these detent elements 70, 72 and 74, the carriage 62 is detained in each of its three operating positions, corresponding to the previously mentioned positions of the operating lever 36.

A suitable operating connection is provided between the lever 36 and the carriage 62. As shown, the rearwardly projecting arm 44 of the lever 36 has a rounded rear portion 76 which is rockably received in a slot 78 formed in the carriage 62.

The operating lever 36 may be made of metal or any other suitable material. As shown, the carriage 62 is made of an electrically insulating material, such as a resinous plastic, which is also strong and resistant to heat.

The switch 30 comprises at least one movable contactor 80 which is mounted on the carriage 62 for movement therewith. The illustrated switch 30 utilizes a single contactor 80 which may be made of copper or some other electrically conductive material.

In accordance with the present invention, the switch 30 incorporates improved means for connecting the contactor 80 to the carriage 62. Thus, the illustrated carriage 62 is formed with a rearwardly extending projection 82 which fits into a slot 84 in the contactor 80. As shown, the projection 82 and the slot 84 are rectangular in shape. To assist in stabilizing the contactor 80, tabs 86 are preferably formed on the contactor 80, tabs 86 are preferably formed on the contactor 80 at the ends of the slot 84. The tabs 86 project rearwardly and are adapted to slide along the sides 88 of the projection 82.

It will be seen that the contactor 80 is generally in the form of a plate which may be made of sheet metal. The switch 30 preferably includes means for biasing the contactor 80 rearwardly, while also biasing the carriage 62 forwardly. As shown to best advantage in FIGS. 6 and 7, this biasing action is provided by one or more springs 90 acting between the carriage 62 and the contactor 80. The illustrated springs 90 are in the form of compression coil springs mounted in openings or recesses 92 formed in the contactor 62. The rear ends of the springs 90 push against the contactor 80.

The resilient force developed by the springs 90 pushes the carriage 62 in a forward direction so that the detent projections 74 on the carriage are pressed into engagement with the detent projections 70 and recesses 72 on the casing 32.

In the switch 30, the contactor 80 is slidable into engagement with a plurality of fixed contacts on the insulating member 48 which supports the terminals 51–55. While the number of contacts may be varied, the illustrated switch 30 has five fixed contacts 101–105 which are mounted on the forwardly facing side of the insulating member 48, within the casing 32. The contacts 101–105 may assume various forms but are illustrated as rounded contact points connected to the respective terminals 51–55. It is preferred to form each contact point in one piece with the corresponding terminal. Thus, the illustrated terminal prongs 51–55 are formed with flanges 111–115 which are bent at right angles to the prongs. The contact points 101–105 are stamped or otherwise formed on the flanges 111–115. As illustrated, the contact points 101–105 are spherically rounded. It will be seen that the terminals 51–55 are staked or otherwise retained in corresponding slots formed in the insulating member 48.

In this case, the switch 30 also has a dummy contact point 116 which is engageable by the contactor 80 but does not establish any electrical connection and thus may be made of an insulating material. The illustrated dummy point 116 is formed integrally with the insulating member 48 and is similar in shape to the active contact points 101–105.

In this case, the contact points 101–105 are arranged in two parallel rows. The contact points 101, 102 and 103 are in one row, while the contact points 104 and 105 are in the second row. The dummy contact point 116 is also in the second row. The points 104, 105 and 116 are staggered relative to the points 101, 102 and 103.

To facilitate the movement of the contactor 80, the ends of the contactor are formed with angular flanges or ramps 118 and 120, adapted to ride easily over the contact points 101–105.

In accordance with the present invention, the switch 30 is preferably provided with means to enable the switch to carry out complex switching functions, without adding materially to the cost of the switch. For this purpose, the switch 30 is formed with at least one cam element for engagement by the contactor 80. The illustrated switch has two such cam elements 122 and 124 for engagement with the opposite edge portions of the contactor 80. In this case, the cam element 122 projects rearwardly, adjacent the contact point 102, while the cam element 124 projects rearwardly adjacent the contact point 104. Preferably, the cams 122 and 124 are formed integrally with the insulating member 48.

The contactor 80 preferably has one or more cam follower elements for selectively engaging the cam elements 122 and 124. As shown, the contractor has a cam follower element 126 along one edge of the contactor, for engaging the cam element 124. The follower element 126 extends along only a portion of the length of the contactor 80. The remainder of the length of the contactor 80 is formed with a cutout 128 which affords clearance for the cam element 124. Along the other edge, the contactor 80 is formed with two cam follower elements 130 and 132 with a cutout 134 therebetween. The cutout 134 corresponds in size to the cam 122 and is adapted to recieve the cam in one position of the contactor. The operation of the switch 30 of FIGS. 1–7 is illustrated to best advantage in FIGS. 8–14. FIGS. 8, 9 and 10 show the contactor 80 in its three positions, designated AUTO-HI and HI, respectively. In the AUTO-LO position of FIG. 8, the contactor 80 engages the contacts 103 and 105. The contactor 80 is lifted away from the contact 102 by the cam 122, which engages the cam follower element 130. There are three points of contact with the contactor 80, these three points of contact being provided by the contacts 103 and 105 and the cam element 122. The other cam element 124 is not engaged by the contactor 80.

In the AUTO-HI position of FIG. 9, the contactor 80 engages the contacts 102 and 105, and also the cam 124, which lifts the contactor away from the contact point 104. The cam 124 engages the follower element 126. The cam 122 is received in the cutout 134, so that the position of the contactor 80 is not affected by the cam 122. The engagement of the contactor 80 with the cam 124 is shown in FIG. 12 and also in FIG. 14.

In the HI position of FIG. 10, the contactor 80 engages the contacts 101 and 104, while also engaging the cam element 122, which lifts the contactor away from the contact 102. The cam 122 engages the follower 132 on the contactor 80. It will be seen that the cutout 128 is opposite the cam 124 so that it does not affect the position of the contactor 80. FIGS. 15–20 show a modified switch 140 which has many of the same components as in the case of the switch 30. To that extent, the components of the switch 140 have been given the same reference characters as the corresponding components of the switch 30, so that the preceding description can be applied to the switch 140. Thus, only the modified features of the switch 140 will need to be covered in the following description.

It will be seen that the operating lever 36 of the switch 140 has four positions which are designated LO, M1, M2 and HI. The lever 36 is movable through a greater range, because the slot 46 in the casing 32 is longer in the switch 140 than in the switch 30. The longer slot 46 is shown in FIG. 17. It will be evident that the ends of the slot 46 act as stops to limit the movement of the rearwardly projecting lever arm 44.

As shown in FIG. 15, the terminal 53 is omitted from the switch 140. The terminals 51, 52, 54 and 55 are the same as before. As illustrated in FIGS. 19 and 20, the contact point 103 is replaced with a dummy point 143, which has no electrical function and thus can be made of an insulating material. The dummy point 143 is preferably formed integrally with the insulating member 48.

The switch 140 has a modified contactor 146 which differs from the contactor 80 of the switch 30 in that the cam follower elements 126, 130 and 132 are eliminated from the contactor 146, so that the contactor 146 never engages the cam elements 122 and 124.

The operation of the switch 140 is illustrated to best advantage in FIGS. 18, 19 and 20, which show the four successive positions of the contactor 146. In FIG. 18, the LO position of the contactor 146 is shown in broken lines. In this position, the contactor 146 engages the contact point 105 and the dummy points 116 and 143. Thus, no circuit is established by the switch.

The first medium position M1 of the contactor 146 is shown in full lines in FIG. 18. It will be seen that the contactor 146 engages the contacts 102 and 105, and also the dummy point 143.

The second medium position M2 of the contactor 146 is shown in FIG. 19. The contactor 146 engages the contact points 102, 104 and 105.

The HI position of the contactor 146 is shown in FIG. 20. The contactor 146 engages the contact points 101, 102 and 104.

The modified switch 140 of FIGS. 15–20 illustrates the fact that a new set of switching functions can be produced by making small changes in the construction of the switch. Thus, a whole family of switches can be produced with the use of virtually the same basic tooling. The insulating member 48 of the switches 30 and 140 can be molded in the same mold, using a different insert to produce the dummy point 143.

FIGS. 21–29 illustrate another modified switch 150 which uses many of the components of the switch 30. To that extent, the components of the switch 150 have been given the same reference characters as the corresponding components of the switch 30.

The switch 150 employs all five terminals 51–55 and the same contact points 101–105 and the dummy point 116, as in the case of the switch 30. As it happens, the switch 150 is shown in an inverted position in FIGS. 21–24, relative to the position in which the switch 30 is shown in FIGS. 1–4. The switch 150 has a modified mounting bracket 152 of a different shape.

The switch 150 has an operating lever 156 which is functionally similar to the lever 36, but of a different shape. In the case of the switch 150, the operating lever has only two positions, designated ON (MAIN) and ON (AUX).

The switch 150 has a slightly modified carriage 158 on which two separate contactors 160 are mounted. Each contactor 160 is in the form of a conductive bar or strip having end tabs 162 which are bent at right angles to the contactor 160. The tabs 162 are slidably received in slots 164 formed in the carriage 158. The two springs 90 are the same as before and are compressed between the carriage 158 and the two contactors 160. Openings or pockets 166 are formed in the carriage 158 to receive and located the springs 90.

The switch 150 of FIGS. 21–29 has a slightly modified casing 168 which is similar to the casing 32 except that the casing 168 has only four detent projections 169 which define the two positions of the carriage 158.

The operation of the switch 150 is illustrated to best advantage in FIG. 27. The contactors 160 are shown in full lines in the position designated ON (MAIN), in which the right-hand contactor establishes a circuit between the contacts 102 and 103. The left-hand contactor 160 engages the contact 105 and the dummy point 116.

In FIG. 27, the contactors 160 are shown in broken lines in their position designated ON (AUX), in which the right-hand contactor 160 engages the contact points 101 and 102. The left-hand contactor 160 engages the contact points 104 and 105.

Here again, the switch 150 illustrates the fact an entirely different switch having different functions can be produced by making small modifications in the construction of the switch.

Returning to FIGS. 7 and 11–13, it will be seen that the cam follower elements 126, 130 and 132 have sloping ramp elements 170 formed along their edges, to facilitate the movement of the cam follower elements over the cam elements 122 and 124.

Oppositely sloping ramp elements 172 and 174 are preferably formed on opposite sides of the cam element 122. Similarly, oppositely sloping ram elements 176 and 178 are preferably formed on opposite sides of the cam element 124. These ramps 172–178 also facilitate the movement of the follower elements 126, 130 and 132 over the cam elements 122 and 124.

The sliding engagement between the projection 82 on the carriage 62 and the slot 84 in the contactor 80 accomodates the rocking movement of the contactor 80 which is produced when the contactor is moved over the cam elements 122 and 124, as shown in FIGS. 11–14.

The projection 82 drives the contactor 80 in the plane of the contactor so that the driving plane is substantially the same as the plane of the frictional resistance afforded to the sliding movement of the contactor along the contact points 101–105. This arrangement is highly advantageous, because it minimizes the tendency of the contactor to tilt and rock as it slides over the contact points.

We claim:

1. An electrical switch, comprising a casing a carriage movable in said casing, a conductive contactor plate mounted on said carriage and movable therewith along a predetermined path, said contactor plate having a longitudinal contacting portion extending longitudinally along said path, a plurality of electrically conductive contact points secured in and to said casing and disposed along said path for selective engagement by said contacting portion of said contactor plate, said casing having an insulating wall securely supporting said contact points, said contact points projecting from said wall to a plane of contact, said carriage having means supporting said contactor plate for movement toward and away from said plane of contact, resilient biasing means acting between said carriage and said contactor plate and biasing said contactor plate toward said plane of contact, a localized cam bump projecting from said wall adjacent one of said contact points, said cam bump projecting from said wall to a greater extent than the adjacent contact point and being spaced laterally from said adjacent contact point away from the path of movement of said contacting portion, said cam bump being longitudinally localized to substantially the same extent as said adjacent contact point relative to the path of movement of said contactor plate, and a cam follower edge portion on said contactor plate and projecting laterally from a localized region of said contacting portion for engaging and sliding along said cam bump to lift said contacting portion away from said contact point against the action of said biasing means for portion of the range of movement of said contactor plate, said contactor plate having a cutout portion along another region of said contacting portion, said cutout portion being spaced from and out of engagement with said cam bump when said contactor plate is positioned with said cutout portion opposite said cam bump to allow said contacting portion to engage said contact point for a portion of the range of movement of said contactor plate.

2. An electrical switch according to claim 1, in which said cam bump is disposed nonsymmetrically relative to said contactor plate and thereby is effective to cause tilting of said contactor plate when said contacting portion is lifted away from said contact point by said cam bump.

3. An electrical switch according to claim 1, including a second localized cam bump projecting from said wall adjacent a second different contact point of said contact points, said second cam bump projecting from said wall to a greater extent than said second contact point and being spaced laterally from said second contact point away from the path of movement of said contacting portion, said second cam bump being longitudinally localized to substantially the same extent as said second contact point relative to the path of movement of said contactor plate, and a second cam follower edge portion on said contactor plate and projecting laterally from a second different localized region of said contacting portion for engaging and sliding along said second cam bump to lift said contacting portion away from said second contact point against the action of said biasing means for a portion of the range of movement of said contactor plate, said contactor plate having a second different cutout portion along another different region of said contacting portion, said second cutout portion being spaced from and out of engagement with said second cam bump when said contactor plate is positioned with said second cutout portion opposite said second cam bump to allow said contacting portion to engage said second contact point for a portion of the range of movement of said contactor plate.

4. An electrical switch according to claim 3, in which said cam bumps are disposed nonsymmetrically relative to said contactor plate whereby each cam bump produces tilting of said contactor plate when said contacting portion is lifted by such cam bump.

5. An electrical switch according to claim 3, in which each of said cam bumps comprises a pair of oppositely sloping ramp surfaces facing in opposite longitudinal directions for causing smooth lifting movement of the corresponding cam follower edge portion as it travels in opposite longitudinal directions over such cam bump.

6. An electrical switch according to claim 1, in which said cam bump comprises a pair of oppositely sloping ramp surfaces facing in opposite longitudinal directions for causing smooth lifting movement over said cam follower edge portion as it is moved in opposite longitudinal directions over said cam bump.

7. An electrical switch, comprising a casing, an insulating carriage movable in said casing, a conductive contactor plate mounted on said carriage and movable therewith along a predetermined path, and electrically conductive contact means secured in and to said casing and disposed along said path for selective engagement by said contactor plate, said contactor plate having a generally rectangular slot therein, said carriage having a generally rectangular insulating projection extending through and mating with said slot for causing said contactor plate to move with said carriage, said contactor plate being slidable along said projection toward and away from said contact means, said switch including resilient biasing means acting between said carriage and said contactor plate and biasing said contactor plate toward said contact means, said contactor plate including a pair of stablizing tabs projecting from said plate on opposite sides of said slot and slidably engaging said insulating projection on opposite sides thereof for stabilizing the sliding movement of said contactor plate along said insulating projection.

* * * * *

UNITED STATES PATENT OFFICE

CERTIFICATE OF CORRECTION

Patent No. 4,022,994 Dated May 10, 1977

Inventor(s) Andrew F. Raab et al.

It is certified that error appears in the above-identified patent and that said Letters Patent are hereby corrected as shown below:

Column 2, line 30, "illustrated" should be --illustrate--

Column 4, line 61, "contractor" should be --contactor--

Column 5, line 7, after "designated" insert --AUTO-LO,--

Column 6, line 43, "located" should be --locate--

Column 7, line 24, after "casing" insert a comma

Column 7, line 55, after "for" insert --a--

Signed and Sealed this

*second* Day of *August 1977*

[SEAL]

*Attest:*

RUTH C. MASON
*Attesting Officer*

C. MARSHALL DANN
*Commissioner of Patents and Trademarks*